US007560211B2

(12) United States Patent
Ishiyama et al.

(10) Patent No.: US 7,560,211 B2
(45) Date of Patent: Jul. 14, 2009

(54) TONER FOR ELECTROSTATIC CHARGE DEVELOPMENT, METHOD FOR MANUFACTURING THE TONER, AND METHOD FOR FORMING AN IMAGE

(75) Inventors: Takao Ishiyama, Kanagawa (JP); Hiroshi Nakazawa, Kanagawa (JP); Masanobu Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 457 days.

(21) Appl. No.: 11/501,751

(22) Filed: Aug. 10, 2006

(65) Prior Publication Data

US 2007/0148576 A1 Jun. 28, 2007

(30) Foreign Application Priority Data

Dec. 22, 2005 (JP) ..... 2005-370949

(51) Int. Cl.
*G03G 9/083* (2006.01)

(52) U.S. Cl. ..... 430/106.1; 430/108.1; 430/109.4; 430/120.1; 430/137.14

(58) Field of Classification Search ..... 430/106.1, 430/108.1, 109.4, 120.1, 137.14
See application file for complete search history.

(56) References Cited

U.S. PATENT DOCUMENTS

| | | | | |
|---|---|---|---|---|
| 5,350,558 | A * | 9/1994 | Kawato et al. | 419/35 |
| 2002/0031713 | A1 * | 3/2002 | Hayashi et al. | 430/108.3 |
| 2006/0105258 | A1 | 5/2006 | Ishiyama et al. | |

FOREIGN PATENT DOCUMENTS

| | | |
|---|---|---|
| JP | A 59-218459 | 12/1984 |
| JP | A 59-218460 | 12/1984 |
| JP | A 63-282752 | 11/1988 |
| JP | A 4-69666 | 3/1992 |
| JP | A 5-61239 | 3/1993 |
| JP | A 6-250439 | 9/1994 |
| JP | A 9-258481 | 10/1997 |
| JP | A 2004-287153 | 10/2004 |

OTHER PUBLICATIONS

Abstract of JP 09258490 A Oct. 3, 1997.*

* cited by examiner

*Primary Examiner*—Hoa V Le
(74) *Attorney, Agent, or Firm*—Oliff & Berridge PLC

(57) ABSTRACT

The present invention provides a toner for electrostatic charge development comprising an amorphous polyester resin, a releasing agent, and magnetic metal particles covered with a resin the main component of which is a crystalline polyester resin.

19 Claims, 2 Drawing Sheets

TONER FOR ELECTROSTATIC CHARGE DEVELOPMENT, METHOD FOR MANUFACTURING THE TONER, AND METHOD FOR FORMING AN IMAGE

BACKGROUND

1. Technical Field

The invention relates to a toner for electrostatic charge development which is used for developing an electrostatic latent image formed by electrophotography, electrostatic recording method, or the like with a developer, and a method for manufacturing the toner, and an image forming method using this toner for electrostatic charge development.

2. Related Art

A method of visualizing image information via an electrostatic charged image by, for example, electrophotography has been used in various fields in recent years. An image is visualized in the electrophotographic method through the steps of forming an electrostatic latent image on a photoreceptor by charging and exposing the photoreceptor, developing the electrostatic latent image with a developer containing a toner, and transferring and fixing the image.

As a developer used here, two-component developers including a toner and a carrier, and one-component developers using only a magnetic toner or a nonmagnetic toner are known. For the manufacturing method of the toner, a kneading pulverization method in which a thermoplastic resin is melted and kneaded with a pigment, a charge control agent, and releasing agent such as wax, cooled and then pulverized and classified is generally used. To these toners, inorganic or organic particles may be added onto the surfaces of the toner particles, if necessary, in order to improve fluidity and clean properties. While this method can provide a quite excellent toner, it involves some problems as described below.

The shape and surface structure of a toner manufactured by the conventional kneading pulverization method becomes irregular. In the kneading pulverization method, it is difficult to intentionally control toner shape and toner surface structure, although they subtly vary depending on the pulverizability of materials to be used and the conditions of pulverizing. Moreover, the range of selection of the materials is limited in the kneading pulverization method. Specifically, in the kneading pulverization method, a dispersion of a resin and a colorant must be a materials which is sufficiently fragile and can be finely-divided with an economically practical production apparatus. However, finer powders may be undesirably generated by a mechanical shear force applied to a toner in a developing apparatus or the shape of the toner may be changed, when the resin colorant is made to more fragile to satisfy the above requirements.

Because of these influences, in one-component developers, it becomes easy by the expansion of the particle size distribution to cause toner scattering at the time of development, and to induce deterioration in image by a decrease in developability due to change in the toner shape. When a toner is prepared by internally adding a large amount of releasing agent such as wax, exposure of the releasing agent on the surface is caused in the toner in some cases, depending on the combination of releasing agent and thermoplastic resin. In particular, in a combination of a thermoplastic resin which has increased elasticity due to a high molecular component and is slightly difficult to pulverize, and a fragile wax which is fragile such as polyethylene and polypropylene, exposure of these wax components are observed on the toner surface in many cases. Exposure of the wax components is advantageous in the removability at fusion and cleaning of untransfered toner from a photoreceptor. However, polyethylene in a superficial layer is easily transfered by mechanical force, and the developing roll, the photoreceptor and the carrier are liable to be contaminated, and thus reliability may be decrease.

Further, when a toner contains magnetic particles, the resistance to bending of the fixed image is low, there is a limitation to the processing speed in order to avoid this problem, and the application of the toner to high-speed processing is difficult.

In recent years, methods for manufacturing a toner by a emulsification-aggregation method has been proposed as a means for enabling intentional control of the toner shape and the surface structure. Generally This is a manufacturing method such that after a resin dispersion solution is prepared by emulsion polymerization or the like, and further, a colorant dispersion solution in which the colorant is dispersed in a solvent is prepared, these dispersion solutions are mixed to form an aggregate corresponding to the toner particle diameter, and the aggregate is fused and coalesced by heating to make a toner.

The shape may be controlled to some extent by this method, and the charging characteristics and durability of the toner may be improved. However since the inner structure of the toner becomes almost unipaper Problems have been left in the removability of a recording media on which an image is formed from a fusing roll, dependency of charging stability on the environmental conditions, and the like.

In such electrophotographic processes, in order to stably maintain toner performance even under various mechanical stresses, it is necessary to suppress exposure of the releasing agent on the surface, enhance the surface hardness without deteriorating the fixability and, at the same time, improve the mechanical strength of the toner itself, and satisfy the need for both sufficient charging property and fixability.

In more recent years, as demand for high image quality rises in the formation of images, there has been a significant trend to make the toner diameter smaller to obtain images of high definition. However, when the toner is simply made small while the particle size distribution is left unchanged, on the minute powder side, the problems of contamination of the carriers and photo receptor and scattering of the toner become significant due to toner particles having an extremely small diameter and it is difficult to achieve the high image quality and the high reliability at the same time. Therefore the particle diameter distribution should be made sharp and the particle diameter is reduced.

Moreover, uniform charging characteristics, stability, toner strength, and sharpness of the particle size distribution are becoming more and more important from the viewpoint of increasing speeds and producing accompanying low energy consumption in recent years. In addition, when increasing speeds energy saving, and the like of these apparatuses, further low-temperature fixability is also required. From these points, toners having excellent properties, manufactured by wet manufacturing methods suitable for manufacturing a toner having sharp particle size distribution and small particle diameter, include toners coalesced by aggregating and fusing, toners produced by suspension polymerization, toners produced by the suspension granulation, and toners coalesced by emulsion suspension aggregation.

In general, the component of releasing agent has an internally added polyolefin wax in order to prevent low-temperature offsetting in the fusing process. Moreover, accompanying this, a small amount of silicone oil is uniformly applied to the fusing roller, which is aimed at improving offsetting at high temperatures. Therefore, it is preferred as silicone oil adheres onto the surface of recording media on which an image is formed and it is not unpleasant to handle because of sticky feeling. For this reason, a toner for oilless fusing which contains a large amount of the releasing agent component has been proposed.

Addition of a large amount of releasing agent can improve the removability to an extent. However, it is difficult to obtain stable removability since a problem of compatibility between the binder component and releasing agent occurs, and stable exudation of the releasing agent is not uniform. Further, since the means for controlling the aggregating force of a binder resin in a toner depends on the Mw and Tg of the binder, it is difficult to directly control the stringiness and the aggregating property of the toner at fusion. Further, liberated components from the releasing agent may cause inhibition of charging.

As a method for resolving these problems, a method of enhansing the rigidity of binder resin by adding a high molecular weight component and a method of improving the removability in oilless fusing by rigidity compensation by the introduction of chemical crosslinking structures into the binder resin and consequentially decreasing the stringiness of toner at a fusing temperature have been proposed.

Moreover, when simply a component of a crosslinking agent is added in the binder, because the viscosity of the toner, that is, aggregation force at the time of fusing becomes large and the rigidity of the binder resin itself is increased, the temperature dependency and the dependency on the applied amount of the toner in the oilless removing are improved to some extent. However, it is difficult to obtain simultaneously surface glossiness of fixed images and the bending resistance of fixed images also becomes low.

In addition, though the molecular weight between intertwining points is certainly increased and the flexibility of the fixed image itself is somewhat improved by simply making the molecular weight of the crosslinking agent high, it is difficult to obtain an appropriate balance between elasticity and viscosity. As a result, the temperature dependency of release in oilless fusing and the dependency on the applied amount of the toner for surface glossiness of the fixed image causes difficulties. Moreover, in the one-component developers which contain metal particles in the toner, this tendency becomes even more significant. Particularly, when the toner is used in energy saving-type fusing apparatus with low temperature and low pressure, and the copier and printers of fast printing type, it is basically difficult to obtain a satisfactory fixed images.

In a one-component developer using magnetic metal particles as a colorant, since the specific gravity of the toner can definitely be increased in a fusing kneading pulverization method, which is a dry process, the coloring function and the charging function can be suitably controlled. Further, stable charging property and coloring property can be manifested at the same time, the system for controlling the toner concentration in the electrophotographic process can be simplified, and an extremely useful toner can be obtained. However, since the controllability of a structure such as a core/shell structure of a toner is deteriorated, there is a problem in fluidity, and it is difficult to obtain a precise image.

In order to solve these problems, new toners and processes are provided, such as an emulsion aggregation and coalescent method (heterogeneous aggregating method), a suspension polymerization method, a solubility suspension granulation method, and a solubility emulsion aggregating coalescent method which are wet processes. However, since these wet processes produce toner particles in an acidic or alkaline aqueous solution, when the fine magnetic metal particles are dispersed in these solution, the surface property of the magnetic material itself is greatly changed by oxidation or reduction and, under acidic conditions, the surface of the magnetic material oxidizes, the color changes to a reddish-brown color and, under the alkaline conditions, iron hydroxide particles are produced, and a change in the magnetism occurs and, therefore, the charging property of the toner is suppressed In addition, under the acidic conditions, a dissolved magnetic particle ions are present in an aqueous solution and, in emulsion aggregation and coalescent methods, since the ion balance in an aggregation system breaks down, it becomes difficult to control the aggregation rate; in a suspension polymerization system, since polymerization is suppressed, it is particularly difficult to control the particle diameter. Further, in a solubility suspension granulation method and a solubility emulsion aggregating coalescent method, it is difficult to obtain particle stability upon granulation or emulsification.

A method of improving these problems has been proposed where the solubility of magnetic metal particles to acid and alkali is decreased in advance, as a means of solving these problems. Problems of manufacturability and color of the toner are certainly improved by these measures.

However, in energy-saving fixing systems of recent years and improved productivity of increased printing speeds, as described above, it is difficult to avoid the lowering of the fusing properties, that is, the bending resistance of the fixed image.

SUMMARY

According to an aspect of the invention, there is provided a toner for electrostatic charge development comprising an amorphous polyester resin, a releasing agent, and magnetic metal particles, and the magnetic metal particles are covered with a resin the main component of which is a crystalline polyester resin.

BRIEF DESCRIPTION OF THE DRAWINGS

Exemplary embodiment(s) of the present invention will be described in detail based on the following figures, wherein.

DETAILED DESCRIPTION

Figure 1:
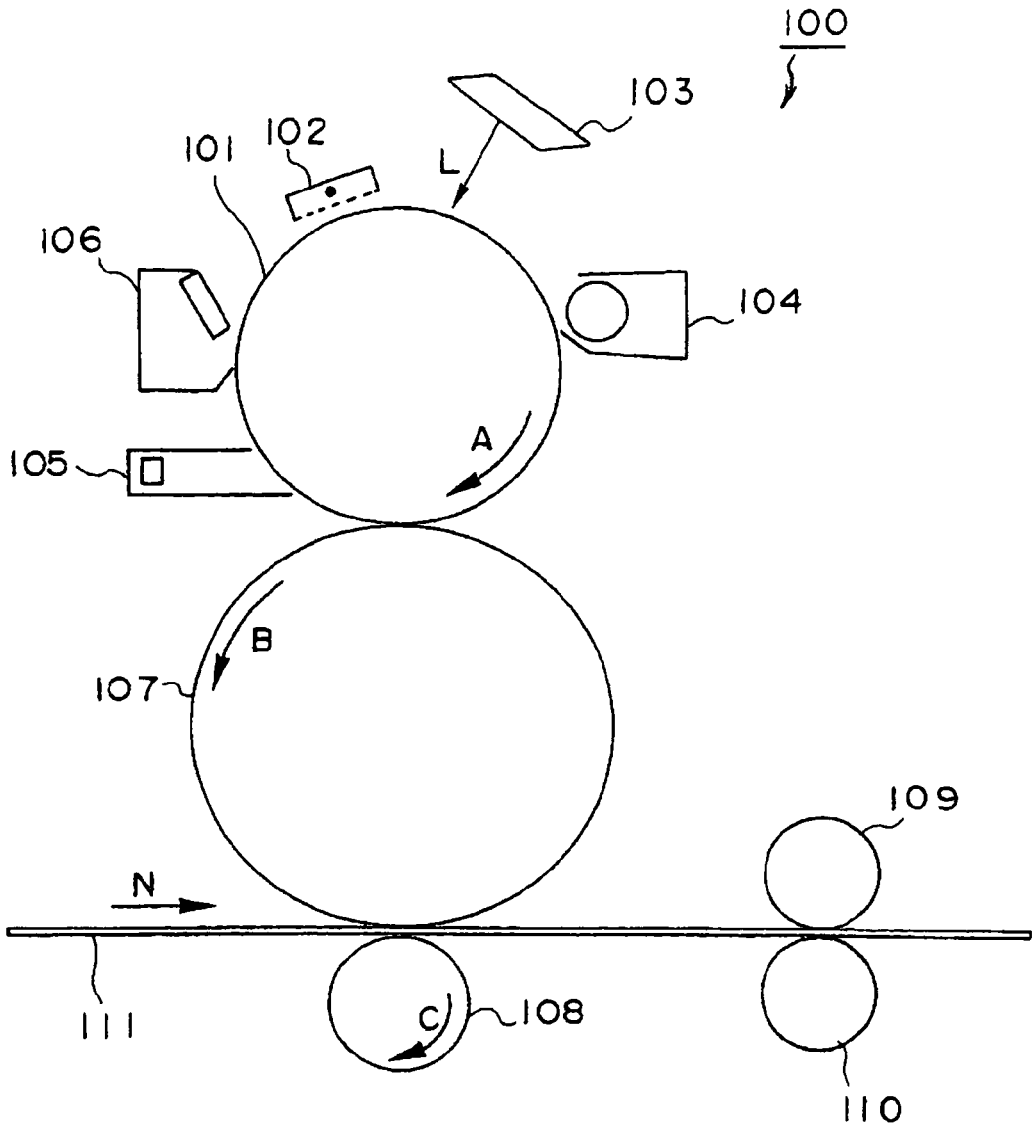
FIG. 1 illustrates a schematic diagram showing one example of the image forming device of the invention.

Hereinafter, the invention will be described in detail.

(Toner for Developing Electrostatic Charge, and the Manufacturing Method of the Same)

The toner for developing the electrostatic charge of the invention (hereinafter, referred to as "the toner of the invention" in some cases) contains amorphous polyester resin, releasing agent, and magnetic metal particles, and the magnetic metal particles are characterized by being covered with the resin in which the main component is crystalline polyester resin. Though generally magnetic metal particles are easily oxidized or reduced, for example, at the time of manufacturing in the wet manufacturing method where toner particles is formed in the aqueous acidic or alkaline medium, by covering the magnetic metal particles with the resin and preventing the surface oxidation causes no, change is caused in the surface characteristic of the magnetic material itself, resulting in suppressing the change in the color tone to reddish brown and the generation of the change in magnetism caused by, for example, the formation of iron hydroxide particles. In addition, because the hybrid structure with the binder resin of the toner mainly composed of amorphous polyester resin can be arbitrarily constructed by covering the toner with the resin of which main component is crystalline polyester resin, the above-mentioned toner containing magnetic metal particles of the invention has excellent color tone, high black color level, and excellent charging characteristics and bending resistance of the fixed image.

-Magnetic Metal Particles-

The above-mentioned magnetic metal particles are covered with the resin of which the main component is crystalline polyester resin and form a covering layer containing the resin that the main component is crystalline polyester resin, so that the magnetic material becomes to be excellent in aqueous layer transferring property, in solubility, and in oxidizability to obtain toner in the aqueous layer. The content (the covered amount) of the resin of which the main component is the above-mentioned crystalline polyester resin is preferably 3 to 30% by mass with respect to the total amount of the binder resin constituting the toner, and more preferably 5 to 25% by mass. When the content of the above-mentioned crystalline polyester resin is over 30% by mass, the dispersibility of the magnetic metal particles inside the toner at the time of toner particle formation may be decreased and the dielectricity of the toner may be decreased. Further, the crystalline polyester resin may be mutually dissolved with the amorphous resin in the binder to generate plasticity and the heat storage stability and liquidity of the toner may be impaired. On the other hand, when the content of the above-mentioned crystalline polyester resin is less than 3% by mass, the covering does not become sufficiently uniform, and when being exposed to the acidic or alkaline atmosphere in the process of manufacturing the toner, the color of the magnetic metal particles may be turned to red by the surface oxidation and the like, and the desired color development may not be obtained.

The above-mentioned magnetic metal particles include substances that are magnetized in the magnetic field, for example, ferromagnetic powder such as iron, cobalt, and nickel, ferrite, magnetite, and black titanium oxide. However, in order to make the solubility in the above-mentioned range, it is preferable to perform, for example, the surface modifying treatment such as, for example, the hydrophobic treatment, on these magnetic metal particles, and to form more than one covering layers by the surface modifying treatment on the surface of the magnetic metal particles.

For example, when magnetic ferrite, magnetite, or black titanium oxide is used as magnetic metal particles, it is preferable to give acid-resistant or alkali-resistant treatment and to form the covering layer. The covering layers by this acid-resistant or alkali-resistant treatment specifically include, for example, a covering layer with a coupling agent; covering layers with gold, platinum, carbon deposition, sputtering, and the like; and covering layers with sodium polyacrylate, potassium polymethacrylate, styrene acrylic acid copolymer. Particularly, in the invention, the covering layer is preferably composed of at least one kind of element selected from Si, Ti, Ca, P, and Sr. These elements may be absorbed on the surface of the particles by the deposition or the sputtering and made as a covering layer (in this case, further, on the surface of that covering layer, a covering layer containing the resin having the crystalline polyester resin as the main component is formed), or may be contained in the covering layer containing the resin having the crystalline polyester resin described later as the main component by dispersing the resin having the crystalline polyester resin as the main component.

The thickness of these covering layers is preferably 1 to 500 nm in weight average film thickness for improving the acid resistance and the alkali resistance, and more preferably 10 to 200 nm. When the thickness is less than 10 nm, the covering is nonuniform and is poor in covering effect, in acid resistance, and in alkali resistance, and these elution and deterioration may not be prevented. Moreover, when the thickness is over 500 nm, not only the particle size distribution may hardly be obtained when covering, but also it becomes economically disadvantageous. Particularly, these covering layers are preferably formed in high density to make the solubility in the above-mentioned range. Further, in order to improve the bending resistance of the fixed image, the resin in which the crystalline polyester resin is the main component is preferably 3 to 30% by mass with respect to the total amount of the binder resin for the above-mentioned reasons.

In the magnetic metal particles, further, in order to obtain the dispersion stably in an aqueous medium, it is suitably carried out to give a compound having the $SO_3$ group and/or the COOH group on the surface of the covering layer to make the surface of the covering layer have the $SO_3^-$ group and/or the $COO^-$ group as the polar groups.

As the method of giving such a compound having the $SO_3$ group and/or the COOH group, specifically, it is carried out to add a compound such as sodium alkylbenzene sulfonate or a mixture containing the same, sodium acrylate, sodium methacrylate, or potassium methacrylate by 0.01 to 3% by mass in the dispersion solution containing the magnetic metal particles. When the amount of the compound added is less than 0.01% by mass, the dispersion effect is small, and the sufficient containment and aggregation property may not be obtained, and when the added amount of the compound is over 3% by mass, it may take a lot of time to remove the compound in washing, resulting in an economical disadvantage.

As described later, although these covering resins can show an sufficient improvement in acid resistance and alkali resistance, the bending resistance of the fixed image can be greatly improved by covering the magnetic metal particles (contains the magnetic metal particles covered with the above-mentioned covering resin) with the crystalline polyester resin.

When the magnetic metal particles on which the covering layer having the $SO_3^-$ group and/or the $COO^-$ group as such a polar group is formed are used, the polarity of the releasing agent is preferably smaller than that of the binder resin. Moreover, from the viewpoint of the charging characteristics and durability, the acid value is preferably 2.5 to 6.0 meq/mg-KOH. Moreover, from the viewpoint of the containment, the difference between the acid value and that of the binder resin (amorphous polyester resin) is preferably 0.5 to 6.0 meq/mg-KOH. More preferably, the acid value of the magnetic metal particles on which the covering layer having the $SO_3^-$ group and/or the $COO^-$ group is formed is 3.0 to 4.5 meq/mg-KOH, and the difference between the acid value and that of the binder resin is 1.5 to 4.0 meq/mg-KOH. Further preferably, the acid value of the magnetic metal particles on which the covering layer having the $SO_3^-$ group and/or the $COO^-$ group is formed is 3.0 to 3.7 meq/mg-KOH, and the difference between the acid value and that of the binder resin is 2.8 to 3.5 meq/mg-KOH.

Here, an acid value is obtained by, for example, KOH titration (neutralization titration). A 1 mol aqueous KOH solution, an aqueous binder resin solution or an aqueous releasing agent solution are prepared, and the amount of KOH titration until neutralization is obtained using methyl orange or the like as an indicator. In addition, the acid value is expressed as an equivalent by dividing the titration amount by the molecular weight of KOH, which is 56.

As for the shape of the above-mentioned magnetic metal particles, globular particles, octahedral particles, rectangular parallelepiped particles, or those mixtures can be used, and these can be used in combination with a color material such as carbon black.

A particle diameter (diameter) of the magnetic metal particle is preferably 50 to 250 nm, more preferably 80 to 220 nm, and further preferably 100 to 200 nm. When the particle diameter is smaller than 50 nm, particles re-aggregate after dispersing treatment and, as a result, large particles are formed, thereby lowering containment in certain cases. On the other hand, when the particle diameter is larger than 250 nm, the dispersing controllability upon formation of the toner particles decreases, making arbitrary control difficult in certain cases.

The content of the above-mentioned magnetic metal particles in the toner of the invention is preferably 5 to 50% by mass, more preferably 30 to 50% by mass, and further preferably 40 to 50% by mass. When the content of the above-mentioned magnetic metal particles is less than 5% by mass, the coloring property decreases, sufficient black color level cannot be obtained, and charging characteristics may become insufficient, too. And when the content is over 50% by mass, the dispersibility of the magnetic metal particles in the toner deteriorates, the color development decreases, the dielectricity of the toner itself deteriorates, and the charging characteristics may be impaired.

-Binder Resin-

Amorphous polyester resins used as a binder resin include a known polyester resin. If the resin is oily and dissolves in solvents with relatively low solubility to water, the resin is dissolved in one of these solvents and the particle emulsion is obtained from the solution by the phase inversion emulsification method, or the solution is dispersed in water in combination with an ionic surfactant and a polyelectrolyte and the dispersion of particles by using a disperser such as a homogenizer, after that, the dispersion is heated or reduce the pressure to evaporate the solvent and thereby the dispersion solution of the resin particles can be prepared.

The particle diameter of the thus obtained dispersion solution of the resin particles may be measured, for example, with a laser diffraction type particle size distribution measuring device (trade name: LA-700, manufactured by Horiba, Ltd.).

Moreover, the crystalline polyester resin to be used for covering the above-mentioned magnetic metal particles (hereinafter, referred to as "the covering resin" in some cases) uses a crystalline resin as the main component. Here, "the main component" indicates the main component among the components composing the above-mentioned covering resin, and specifically indicates the component that composes 50% by mass or more of the above-mentioned covering resin. However, in the invention, the crystalline polyester resin is preferably 70% by mass or more among the above-mentioned covering resin, more preferably 90% by mass, and particularly preferably, all of the resin is the crystalline polyester resin. When the resin composing the above-mentioned binder resin is not a crystalline type, that is, when the resin is amorphous, toner blocking property and image storability cannot be maintained while the low temperature fixability is secured. In addition, "the crystalline resin" indicates one having not a stepwise change in the amount of heat absorbed but a clear endothermic peak in the differential scanning calorimetry (DSC).

The crystalline polyester resins are not specifically limited as long as being a polyester resin with crystallinity, and aliphatic crystalline polyester resins having a moderate melting point are more preferable.

The crystalline polyester resin is the one synthesized from an acid (dicarboxylic acid) component and an alcohol (diol) component. Moreover, in the invention, such copolymers are also considered to be crystalline polyester resins that other components are copolymerized at the percentage of 50% by mass or less to the above-mentioned crystalline polyester main chain.

The process for preparing the crystalline polyester resin is not particularly limited, and can be prepared with a general polyester polymerizing method in which an acid component and an alcohol component are reacted. In addition, examples of usable polyester polymerizing methods include a direct polycondensing method and an ester exchanging method, and these methods are applied depending on the kind of monomer The manufacturing of the crystalline polyester resin can be performed at the polymerization temperatures from 180° C. to 230° C., and the reaction system is decompressed as need arises and inside of the reaction is carried out while water and alcohol generated during the condensation are removed. When the monomer does not dissolve or is not compatible at the reaction temperature, a solvent with a high boiling point may be added as a solubilizing agent to dissolve the monomer. The polycondensation reaction is carried out while the solubilizing agent is distilled and removed. When a monomer with low compatibility exists in the copolymerization reaction, it is preferred that the monomer with low compatibility is condensed in advance with the acid or the alcohol, which are intended to be polycondensed with the monomer, and then the polycondensation is carried out in combination with the main component.

Catalysts that can be used in the preparation of the crystalline polyester resin include alkali metal compounds such as sodium and lithium; alkaline earth metal compounds such as magnesium and calcium; metallic compounds such as zinc, manganese, antimony, titanium, tin, zirconium, and germanium; phosphite compounds, phosphate compounds, and amine compounds, and specifically, following compounds are included.

Specific examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-t-butylphenyl) phosphite, ethyltriphenyl phosphonium bromide, triethylamine, triphenylamine and the like.

The melting points of the crystalline polyester resins are preferably 60 to 90° C., and more preferably 60 to 80° C. When the above-mentioned melting point is lower than 60° C., the toner storage stability and the storage stability of the toner image after fixation may become problem. On the other hand, when the melting point is over 90° C., the bending resistance of the fixed image may not be obtained sufficiently.

Here, the melting point of the crystalline resin is measured using a differential scanning calorimeter (DSC). The melting point of the crystalline resin can be obtained as a melting peak temperature of input-compensated differential scanning calorimetry shown in JIS K-7121 when measured from room temperature to 150□C at a temperature rising rate of 10□C per min. In addition, the crystalline resin exhibits multiple-melting peaks in certain cases and, in the present invention, the maximum peak is regarded as the melting point.

-Releasing Agent-

As a releasing agent used in the toner of the invention, a substance having a main maximum peak, as measured with a ASTMD3418-8, in the range of 50 to 140° C. is preferable. When the main maximum peak is lower than 50° C., offset tends to occur at fixation. On the other hand, when the main maximum peak is higher than 140° C., the fixing temperature also increases and, since the smoothness of the image surface is insufficient, there are cases where the glossiness is damaged For the measurement of the main maximum peak, for example, DSC-7 (trade name) manufactured by PerkinElmer, Inc. may be used. The melting points of indium and zinc are used to calibrate the temperature of the detector of the measuring apparatus, and the heat of melting indium is used to calibrate heat quantity. An aluminum pan is used as a sample, an empty pan is set for the control, and the measurement is carried out at the temperature rising rate of 10° C./min.

As for the viscosity of the releasing agent, the viscosity at the temperature in the beginning of the fixation, for example, at 180° C. is preferably 15 mPa.·s or less, more preferably 1 to 10 mPa.·s, and further preferably 1.5 to 8 mPa.·s. When the viscosity is over 15 mPa.·s, the elution of the releasing agent at the time of fixation decreases, and the removability deteriorates and the offsetting is caused easily in certain cases.

The releasing agent is preferably contained 5 to 30% by mass in the toner as the content obtained from the area of the endothermic peak. The content is more preferably 5 to 25% by mass, and further preferably 5 to 20% by mass.

The releasing agent is dispersed in water in combination with an ionic surfactant and polyelectrolytes such as a high molecular acid and a high molecular base, and the particles is made from the dispersion with a homogenizer or a pressure discharge type disperser, which can heat the dispersion to the melting point or higher and can shear it strongly, and the dispersion solution of the releasing agent which has the releasing agent particles of 1 μm or less in particle diameter can be prepared. The particle diameter of the obtained dispersion solution of the releasing agent can be measured, for example, with a laser diffraction type particle size distribution measuring apparatus (trade name: LA-700, manufactured by Horiba, Ltd.).

In terms of charging property and durability, it is preferable that the releasing agent has a polarity smaller than that of the binder resin particles. That is, it is preferable from the viewpoint of good containment that the acid value of a releasing agent is less than that of the binder resin by 0.5 meq/mg-KOH or more.

Here, the acid value in the invention can be obtained by, for example, KOH titration (diselectrificating titration). The aqueous KOH solution of 1 mol is made, and aqueous solution of a binder resin or releasing a releasing agent is prepared, and the amount of KOH titration until neutralizing is obtained by using the methyl orange and the like in this aqueous solution as an indicator. In addition, the acid value is shown as the equivalence of the value obtained by dividing the titration amount by the molecular weight 56 of KOH.

Examples of the releasing agents include low molecular weight polyolefins such as polyethylene, polypropylene, and polybutene; silicones which have softening points by heating; fatty acid amides such as oleic amide, erucic amide, ricinoleic acid amide, and stearic acid amide; vegetable wax such as carnauba wax, rice wax, candelilla wax, Japan wax, and jojoba wax; animal wax such as yellow beeswax; mineral or petroleum wax such as montan wax, ozokerite, ceresin, paraffin wax, microcrystalline wax, and Fischer-Tropsch wax; and further those modified products can be used.

-Other Materials-

In the toner of the invention, a colorant may be used together with the aforementioned magnetic metal particle. Known colorants can be used. Examples of usable black pigments include carbon black, copper oxide, black titanium oxide, black iron hydroxide, manganese dioxide, aniline black, active carbon, non-magnetic ferrite, magnetic ferrite, and magnetite. In addition, as a colorant it is possible to use dyes. Usable dyes include basic dye, neutral dye, acidic dye, dispersion dye, and direct dye, for example, nigrosine. These dyes may be used in simple or mixed condition, and in the state of solid solution.

These colorants are dispersed in an aqueous solution by known methods, preferably using devices such as a rotation shearing-type homogenizer, a media-type dispersing machine such as a ball mill, a sand mill, an attritor and the like, and a high pressure counter-collision dispersing machine.

In addition, these colorants may be selected in the view point of dispersion properties since these colorants including carbon black with magnetic metal particles are dispersed in water by a homogenizer using polar surfactants.

In order to improve and stabilize the charging property, the toner of the invention can contain an electrification controlling agent. The charge-controlling agent can be any of various charge-controlling agents normally used, such as a dye (e.g., quaternary ammonium salt compound, nigrosin type compound, dye comprising a complex of aluminium, iron, chromium) and a triphenylmethane type pigment can also be used. As the electrification controlling agent, materials that do not dissolve easily in water are suitable both for controlling the ionic strength, which influences the stability at aggregation or coalescence, and reducing waste water pollution.

Inorganic particles can be added in the toner of the invention by the wet process to stabilize the charging characteristics.

As examples of this inorganic particles that can be added, all of those ordinarily used as external additives on the surface of the toner such as silica, alumina, titania, calcium carbonate, magnesium carbonate, and tricalcium phosphate can be used by dispersing with an ionic surfactant and a high molecular acid and a high molecular base.

In addition, for the purpose of imparting the flowability or improving the cleanability, inorganic particles (e.g. silica, alumina, titania, calcium carbonate etc.) or resin particles (vinyl type resin, polyester, silicone etc.) may be added to the toner of the invention. These particles are added to the surface by applying shear in the dry state of a toner, and as aids for flowing or cleaning.

-Characteristics of the Toner-

The toner of the invention is desirable to be cooled at the rate of 15° C./minute when it is cooled from temperatures of the melting point of the crystalline resin or higher to temperatures of the melting point or lower (preferably 60° C. or lower). Further, it is preferably cooled at the rate of 20° C./minute or more for the crystalline size of the crystalline resin. Since the toner of the invention contains a crystalline resin, the rate when cooling from the state where the resin is melted, that is, generally temperatures of the melting point or higher to temperatures that the resin freezes, that is, temperatures of the melting point or lower may influence the size of the crystal of the resin. Specifically, in the slow cooling in the range of the cooling rate of 15° C./minute or less, because the crystal growth occurs and the crystal becomes enlarged within the toner, not only the injection charging characteristics deteriorates due to the decrease in the toner strength and in the electrical resistance, but the enlarged crystalline resin may be exposed to the surface of the toner to cause the decrease in the charging characteristics and fluidity of the toner.

The volume average particle diameter of the toner of the invention is preferably 1 to 12 μm, more preferably 3 to 9 μm, and further preferably 3 to 8 μm. Moreover, the number average particle diameter of the toner of the invention is preferably 1 to 10 μm, and more preferably 2 to 8 μm. When these particle diameters of the toner are too small, not only the manufacturability becomes unstable, but also the involved structure is hardly controlled and the charging characteristics becomes insufficient, and consequently the developability may be lowered, and when these particle diameters are too large, the resolution of the image may be decreased.

It is preferable that a volume average particle size distribution index GSDv of the toner of the invention is 1.30 or less. In addition, it is preferable that the ratio of a volume average particle diameter distribution index GSDv and a number average particle size distribution index GSDp (GSDv/GSDp) is 0.95 or greater.

When the above-mentioned volume average particle diameter distribution index GSDv is over 1.30, the resolution of the image may be decreased. In addition, when the ratio of the volume average particle size distribution index GSDv to the number average particle size distribution index GSDp (GSDv/GSDp) is less than 0.95, the decrease in the charging characteristics of the toner, the scattering of the toner, fog, and the like may occur to cause the image defect.

Further, in the invention, the values of the particle diameters of the toner and the magnetic metal particles, and the above-mentioned volume average particle size distribution index GSDv and number average particle size distribution index GSDp are measured and calculated as follows. First, about the particle size distribution of the toner that is measured with a measuring instrument such as Coulter Multisizer II (trade name, manufactured by Beckman Coulter, Inc.), the cumulative distribution charts of the volume and the number of respective toner particles are drawn for the divided range of the particle size (channel) from the small particle diameter side. And, the particle diameters where the accumulation is 16% in the charts are defined as the volume average particle diameter D16v and the number average particle diameter D16p, and the particle diameters where the accumulation is 50% are defined as the volume average particle diameter D50v and the number average particle diameter D50p. Similarly, the particle diameters where the accumulation is 84% are defined as the volume average particle diameter D84v and the number average particle diameter D84p. On this occasion, the volume average particle size distribution index (GSDv) is defined as D84v/D16v, and the number average particle size distribution index (GSDp) is defined as D84p/D16p. Using these relational expressions, the volume average particle size distribution index (GSDv) and the number average particle size distribution index (GSDp) can be calculated.

The absolute value of an electrification amount of the toner of the invention is preferably 15 to 60 μC/g, and more preferably 20 to 50 μC/g. When the electrification amount is less than 15 μC/g, background staining (i.e., fog) tends to occur and when the electrification amount exceeds 60 μC/g, image concentration tends to reduce easily.

Moreover, in the toner of the invention, the ratio of the charged amount in summer (high temperature and humidity) to the electrification amount in winter (low temperature and humidity) is preferably 0.5 to 1.5, and further preferably 0.7 to 1.3. When the above-mentioned ratio is beyond the limits of these, the environmental dependency of the charging characteristics is strong and the stability of the electrification is lacked, which are not preferable for the practical use of the toner.

It is preferable to make a shape factor of the toner of the invention $110 \leqq SF1 \leqq 140$ in terms of the image formation. As for this shape factor SF1, the mean value of the shape factor (the square of the absolute maximum length/the projected area) is calculated, for example, by the following method. Optical microscopic images of the toner particles scattered on the slide glass are taken in the Luzex image analyzer through a video camera, and at least 50 toner images are used as sample. The square of the absolute maximum length/the projected area ($ML^2/A$) are calculated to obtain the mean value, then SF1 is obtained by the following expression.

$$SF1=(ML^2/A)\times(100\pi/4)$$

wherein, ML indicates the absolute maximum length, and A indicates the projected area.

As for the toner of the invention, the maximum value of the endothermic peak obtained by the differential thermal analysis is preferably 70 to 120° C. from the viewpoint of the oilless removability and manufacturability of the toner, more preferably 75 to 110° C., and further preferably 75 to 103° C.

As for the toner of the invention, it is preferable that the viscosity of the above-mentioned releasing agent is 15 mPa.·s or less at 180° C., the endothermic maximum value of the above-mentioned toner that is obtained by the differential thermal analysis is 70 to 120° C., and the content of the releasing agent that is obtained based on the area of the endothermic peak is 5 to 30% by mass.

By satisfying each of the above-mentioned characteristics of the toner, such one-component toner for electrostatic charge development can be obtained that the charging characteristics is excellent and the difference between colors in the electrification is also small even in the high speed processing, and there is no variation in the removability due to the temperature and excellent glossiness is maintained in the oilless fixing, and is excellent in the fixing properties such as adhesiveness of the fixed image to the fixed sheet, the removability of a fixed sheet, HOT resistance (hot offsetting property), the bending resistance of the fixed image, and the surface glossiness of the fixed image.

-Method for Manufacturing the Toner-

Though the toner of the invention is preferably manufactured by the wet method, in which toner particles are formed in an acidic or alkaline aqueous solution, such as the aggregation and coalescence method, using the above-mentioned magnetic metal particles, for example, in the aggregation coalescence method, the collapse of the ion balance in the aggregation system is suppressed and it becomes easy to control the aggregation rate, and consequently it becomes possible to stabilize the particles when granulating and emulsifying them.

The aggregation and coalescence method is a manufacturing method comprising the aggregation step where a resin particle dispersion solution in which resin particles of at least 1 μm or less are dispersed, a magnetic metal particle dispersion solution in which magnetic metal particles covered with a crystalline polyester resin are dispersed, and dispersion solution in which particles of releasing agent are dispersed are mixed to form aggregated particles of the resin particles, the magnetic metal particles covered with the crystalline polyester resin, and the releasing agent particles; and the fusion and coalescing step where the aggregated particles are heated to temperatures of the glass transition point or higher of the resin particles and are fused and coalesced.

Specifically, in the method, using a resin dispersion solution in which resin particles generally manufactured by the phase inversion emulsification method and the like are dispersed with an ionic surfactant, a dispersion solution in which magnetic metal particles covered with a crystalline polyester resin are dispersed with an ionic surfactant having opposite polarity, and others are mixed to induce hetero-aggregation. Next, the resin particles are added to this dispersion solution and are adhered and aggregated on the surface of the hetero-aggregated particles to form aggregated particles of the toner diameter. After that, the aggregates are fused and coalesced by heating them to temperatures of the glass transition point or higher of the resin particles, and washed and dried.

Moreover, the process may be performed by collectively mixing and aggregating, or by such a method that in the aggregation step, the balance of the amount of the ionic dispersant of each polarity is initially shifted in advance, for example, using the polymer of at least one kind of metallic salt, this is neutralized in ions to form a parent aggregation in the first stage at temperature of the glass transition point or lower, and after the parent aggregation is stabilized, as the second stage, the particle dispersion solution treated with the dispersant of the polarity and the amount, by which the gap of the balance is compensated, is added to the parent aggregation, in addition, the parent aggregation is slightly heated at the glass transition point or lower of the resin contained in the parent body or in the added particles and stabilized at still higher temperatures, and then the parent aggregation is heated to the glass transition point or higher and is made to be coalesced, while the particles added at the second stage of the aggregation formation is adhered on the surface of the parent aggregation particles. In addition, the phased operation of this aggregation may be repeatedly executed two or more times.

In the aggregation step, as for the polymer of at least one kind of metallic salt which is added at the time of mixing each dispersion solution, the polymer of the above-mentioned metallic salt is preferably the polymer of tetravalent aluminum salt or a mixture of the polymers of tetravalent aluminum salt and trivalent aluminum salt. And these polymers include, specifically, polymers of inorganic metal salts such as calcium nitrate, or polymers of inorganic metal salts such as polyaluminum chloride. Moreover, the polymer of this metal salt is preferably added so that the concentration is to be 0.11 to 0.25% by mass.

It is suitable that the aggregation step comprises a first aggregation step of mixing a resin minute particle dispersion in which at least a first resin minute particles having a particle diameters of 1 μm or smaller are dispersed, a magnetic metal minute particle dispersion in which a magnetic metal minute particles are dispersed, and a releasing agent particle dispersion in which a releasing agent particles are dispersed, to form a core aggregated particles containing the first resin minute particles, the magnetic metal minute particles and the releasing agent particles,; and a second aggregation step of forming a shell layer containing a second resin minute particles on the surfaces of the core aggregated particles to obtain a core/shell aggregated particles.

In the first aggregation step, firstly, the dispersion solution of the first resin particle, the dispersion solution of the magnetic metal particle covered with the crystalline polyester resin, and the dispersion solution of the releasing agent particles are prepared. The dispersion solution of the first resin particles is prepared by dispersing the first resin particles manufactured by the emulsion polymerization and the like in a solvent with an ionic surfactant. The colorant particle dispersion is prepared by dispersing colorant particles having the desired color such as blue, red, and yellow in a solvent using an ionic surfactant having the opposite polarity to that of the ionic surfactant used for preparing the resin particle dispersion. In addition, the releasing agent particle dispersion is prepared by dispersing a releasing agent together with an ionic surfactant and a polymer electrolyte such as a polymer acid and a polymer base in water, and heating to a melting point or higher and, at the same time, applying strong shear with a homogenizer or a pressure discharge-type dispersing machine to finely-divide the material.

Next, the dispersion solution of the first resin particles, the dispersion solution of a colorant particles, and the dispersion solution of the releasing agent particles are mixed, and the first resin particles, the colorant particles, and the releasing agent particles are made to hetero-aggregate to form the aggregated particles (core aggregated particles) that have the diameter almost closer to the desired diameter of the toner and contain the first resin particles, the colorant particles, and the releasing agent particles.

In the second aggregation step, second resin particles are adhered to the surface of the core aggregated particles obtained in the first aggregation step using the second resin particle dispersion containing second resin particles. In this fashion, a covering layer (i.e., shell layer) of a desired sickness is formed, and aggregated particles (i.e., core/shell aggregated particles) having a core/shell structure in which a shell layer is formed on the particle surfaces thereof. The second resin particles used upon this may be the same as or different from the first resin particles.

Moreover, the particle diameters of the first resin particles, the second resin particles, the magnetic metal particles, and the releasing particles that are used in the first and second aggregation steps are preferably 1 μm or less in order to facilitate the adjustment to the desired values of the diameter and particle size distribution of the toner, and more preferably in the range of 100 to 300 nm.

In the first aggregation step, the balance of the amounts of two polar ionic surfactants (dispersant) contained in the dispersion solution of the first resin particles and the dispersion solution of the magnetic metal particles covered with the crystalline polyester resin can be shifted in advance. For example, this is ionically neutralized using an inorganic metal salt (e.g., calcium nitrate, etc.), or a polymer of an inorganic metal salt (e.g., poly(aluminium chloride) etc.), and may be heated to the glass transition temperature of the first resin particles, or lower, to prepare core aggregated particles.

In such a case, in the second aggregation step, the dispersion solution of the resin particles that are treated with the dispersant of the polarity and the amount which compensates the gap of the balance of the two polar dispersants as described above is added in the solution containing the core aggregated particles, and further slightly heated, as need arises, at the glass transition point or lower of the core aggregated particles or the second resin particles used in the second aggregation step to manufacture core/shell aggregated particles.

Moreover, the first and second aggregation steps may be repeated stepwise dividing into plural times.

Next, in the fusion and coalescing step, the aggregated particles (the core/shell aggregated particles in case of having the first and second aggregation steps) obtained through the aggregation step (the second aggregation step) are heated in the solution to the glass transition temperature or higher of the resin particles contained in this aggregated particles (the glass transition temperature of the first or second resin particles contained in the core/shell aggregated particles in case of having the first and second aggregation steps, the glass transition temperature of the resin having the highest glass transition temperature in case of two or more kinds of resins) to be fused and coalesced, resulting in the toner.

Moreover, in the invention, it is preferable to have the cooling step by which the aggregated particles fused and coalesced in the above-mentioned fusion and coalescing step are cooled to 60° C. at the rate of 15° C. or higher/minute. The crystal growth of the crystalline resin contained in the above-mentioned toner is suppressed by having the cooling step, and the resin is made to be minute, the formation of an electric continuity passage in the toner is controlled, and the exposure of the resin to the surface of the toner is prevented. Such results are preferable from the viewpoint of controlling the injection charging characteristics of the toner, and maintaining the liquidity and charging characteristics of the toner. Moreover, as the cooling step, quenching within the liquid supply-piping route at the time of exhaustion is preferable, and cooling is performed in the liquid supply process through the heat exchanger. As for the capacity of the heat exchanger in this case, the one of 5 to 8 $m^2$ in heat transfer area is preferably used. Especially, because the generation of the slow cooling by the delay of the exhaust time is suppressed, the spiral-type heat exchanger is preferable. In addition, though refrigerants in this case are not specifically limited as long as those used as a refrigerant such as brine and well water, the flow rate is adjusted so that temperature at the entrance to the heat exchanger is 25° C. or lower and temperature at the exit is 50° C. or lower. As for the temperature of the slurry, temperatures in the range of that in the coalescing stage to 65° C. are preferably used. In this case, when the slow cooling from the temperature of the coalescing stage to 60° C. is carried out, the crystal growth in the crystalline resin may occur.

As the examples of the surfactant that can be used in the case where the toner of the invention is manufactured, it is also effective to use anionic surfactants such as sulfate esters, alkylbenzene sulfonates, phosphates, and soaps, cationic surfactants such as amine salt types and quaternary ammonium salt types, and nonionic surfactants such as polyethylene glycols, alkylphenol ethylene oxide adducts, and polyhydric alcohols in combination.

Moreover, as a means for dispersion, ordinary means such as a rotary shearing type homogenizer, and those having a medium such as a ball mill, a sand mill, and a dino mill can be used.

After particle formation, a dispersing agent is removed with an aqueous solution of a strong acid such as hydrochloric acid, sulfuric acid, and nitric acid, rinsed with ion-exchanged water until the filtrate becomes neutral, after which a washing step, a solid liquid separation step, and a drying step are arbitrarily performed to obtain the desired toner. The solid-liquid separation step is not particularly limited, but from the viewpoint of productivity, methods such as suction filtration and pressure filtration are preferably used. Further, the drying step is not particularly limited, but from the viewpoint of productivity, lyophilization, flush jet drying, flowing drying, vibration type flowing drying and the like are preferably used.

Moreover, the magnetic metal particles covered with the resin having crystalline polyester resin as the main component can be obtained in the following steps: at least the crystalline polyester resin is dissolved in a solvent, and the magnetic metal particle are added to the solution in the existence of an anionic surfactant while the solution is stirred and given shearing at temperatures of the melting point or higher of the resin and the boiling point or lower of the solvent and the magnetic metal particles are covered with the crystalline polyester resin, and then water of equivalent amount or more to this is added to give the emulsified dispersion solution of the magnetic metal particles.

(The Method for Forming an Image)

Next, the method for forming an image using the toner of the invention will be described.

The method for forming an image of the invention is a method for forming an image comprising at least the electrification step of charging the surface of an image supporting member uniformly, the electrostatic latent image forming step of forming an electrostatic latent image corresponding to image information on the surface of the above-mentioned uniformly electrified image supporting member, the developing step of developing the above-mentioned electrostatic latent image formed on the surface of the above-mentioned image support member with a developer containing at least the toner to give a toner image, and the fixing step of fixation the above-mentioned toner image on the surface of the recording medium, and the method is characterized by using the above-described toner of the invention as the above-mentioned toner.

Therefore, because the method for forming an image of the invention uses the above-described toner of the invention, it is possible to obtain an image in that the color tone is excellent, black color level is high, and is excellent in the bending resistance of the image even in the high speed processing.

Moreover, though the method for forming an image of the invention is not specifically limited as long as the method contains at least the electrification step, the electrostatic latent image forming step, the developing step, and the fixing step as described above, the method may contain other steps, for example, may contain the transfer step of transferring the toner image formed on the surface of the image support member after passing the developing step on the transfer receiving material, and the like.

The image forming apparatus used in the method for forming an image of the invention is an image forming apparatus comprising at least the electrification means of charging the surface of an image supporting member uniformly, the electrostatic latent image forming means of forming an electrostatic latent image corresponding to image information on the surface of the above-mentioned uniformly electrified image supporting member, the development means of developing the above-mentioned electrostatic latent image formed on the surface of the above-mentioned image supporting member with a developer containing at least the toner to give a toner image, and the fixing means of fixation the above-mentioned toner image on the surface of the recording medium.

Moreover, the image forming apparatus used in the method for forming an image of the invention contains at least the electrification means, the electrostatic latent image forming means, the development means, and the fixing means as described above, and further may contain other means, for example, may contain the transfer means of transferring the toner image formed on the surface of the image supporting member after passing the developing step on the transfer receiving material, and the like.

Next, the method for forming an image of the invention using the image forming apparatus as described above will be described specifically. However, the invention should not be limited only to the specific examples to be described below.

FIG. 1 is a schematic view showing one example of the image forming apparatus. In FIG. 1, the image forming apparatus 100 is consisted of an image supporting member 101, an electrifier 102, a writing apparatus for forming an electrostatic latent image 103, a developing device 104 holding developers of each color of black (K), yellow (Y), magenta (M), and cyan (C), a diselectrification lamp 105, a cleaning apparatus 106, an intermediate transfer receiving material 107, and a transferring roll 108. Moreover, the toner of the invention is contained in the developer housed in the developing device 104.

At the periphery of the image supporting member 101, there are disposed, in an order along a rotational direction (direction of arrow A) of the image supporting member 101, a non-contact type electrifier 102 for uniformly electrifying the surface of the image supporting member 101; a writing apparatus 103 for forming an electrostatic latent image corresponding to image information on the surface of the image supporting member 101 by irradiating the surface of the image supporting member 101 with the scanning exposing light shown by an arrow L; developing devices 104 for supplying toners of their respective colors to the electric latent image, a drum-like intermediate transfer receiving material 107 which abuts against the surface of the image supporting member 101 and can follow-up rotate in an arrow B direction accompanied with rotation of the image supporting member 101 in an arrow A direction; a destaticizing lamp 105 for destaticizing the surface of the image supporting member 101; and a cleaning apparatus 106 abutting against the surface of the image supporting member 101.

In addition, a transferring roll 108, which can control abutting/non-abutting, is disposed on the surface of an intermediate transfer receiving material 107 on the opposite side of the image supporting member 101 relative to the intermediate transfer receiving material 107 and, upon abutting, the transferring roll 108 can follow-up rotate in an arrow C direction accompanied with rotation of the intermediate transfer receiving material 107 in an arrow B direction.

A recording medium 111, which is conveyed by a conveying means (not shown) from an opposite side to an arrow N direction to an arrow N direction, can penetrate between the intermediate transfer receiving material 107 and the transferring roll 108. On the arrow N direction side of the intermediate transfer receiving material 107, a fixing roll 109 housing a heating source (not shown) is disposed and, on the arrow N direction side of the transferring roll 108, a pushing roll 110 is disposed, and the fixing roll 109 and the pushing roll 110 are contacted by pressure, forming a pressure contacting part (nip part). In addition, the recording medium 111, which has passed between the intermediate transfer receiving material 107 and the transferring roll 108, can penetrate through this pressure contacting part in an arrow N direction.

Moreover, because the image forming apparatus used in the method for forming an image of the invention uses the toner of the invention that is excellent in removability at the time of fixation, the surface of the fixing roll 109 needs not be covered with the film of low surface energy such as a fluorine resin film as in the conventional cases. In such a case, the surface of the fixing roll 109 may be, for example, the directly exposed SUS or Al material that is a metallic core material.

In the next place, the image formation using the image forming apparatus will be described. First, along with the rotation of the image supporting member 101 in an arrow A direction, the surface of the image supporting member 101 is uniformly electrified with a non-contact type electrifier 102, an electrostatic latent image corresponding to each color image information is formed on the uniformly electrified surface of the image supporting member 101 with the writing apparatus 103, and the toner of the invention is supplied on the surface of the image supporting member 101 on which the electrostatic latent image is formed from a developing device 104 according to the color information on the above-mentioned electrostatic latent image, and thus the toner image is formed.

Next, the toner image formed on the surface of the image supporting member 101 is transferred onto the surface of an intermediate transfer receiving material 107 in the contact part of the image supporting member 101 and the intermediate transfer receiving material 107 by applying voltage to the image supporting member 101 with the power source not shown in the figure.

The surface of the image supporting member 101 is diselectrified according to the illumination of light from the diselectrification lamp 105. In addition, the toner remained on the above-mentioned surface is removed with the cleaning blade of the cleaning apparatus 106.

The toner image thus laminated and formed on the intermediate transfer receiving material 107 moves to the contact part of the intermediate transfer receiving material 107 and the transferring roll 108 along with the rotation of the intermediate transfer receiving material 107 in an arrow B direction. At this time, the recording medium 111 is penetrated in an arrow N direction with a form conveying roll not shown in the figure, and the formed toner image is collectively transferred on the surface of the recording medium 111 in the contact part by the voltage applied between the intermediate transfer receiving material 107 and the transferring roll 108.

The recording medium 111 on the surface of which the toner image is thus transferred is conveyed to the nip part between the fixing roll 109 and the pressing roll 110, and when being passed through the nip part, the recording medium 111 is heated with the fixing roll 109 the surface of which is heated by a built-in heating source (not shown in the figure). At this time, the toner image is fixed on the surface of the recording medium 111, resulting in the formation of the image.

Figure 2:
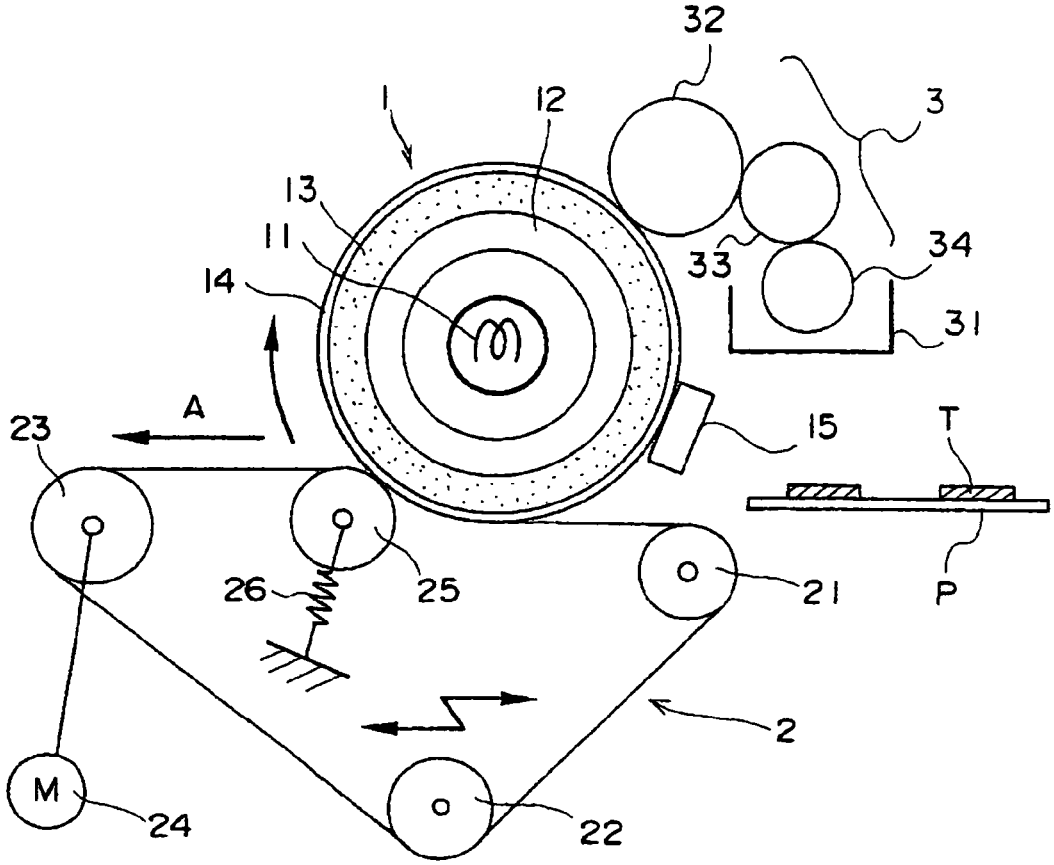
FIG. 2 illustrates a schematic diagram showing one example of the fixing device to be applied to the image forming device of the invention.

The aforementioned fixing step may be performed by using the fixing apparatus illustrated in FIG. 2. While referring to FIG. 2, the fixing apparatus used in the image forming method of the invention will be explained. As show in FIG. 2, the fixing apparatus is provided with a heating fixing roll 1, a plurality of supporting rolls 21, 22, 23 and an endless belt (heat resistant belt) 2 tensed by these rolls. The fixing apparatus used in the invention may be provided with another endless belt so as to surround the heating fixing roll 1, and may be configured to form a nip between the fixing roll and the endless belt 2 via another such endless belt.

The heating fixing roll 1 is structured such that an undercoat layer (heat resistant elastomer layer) 13 composed of a heat resistant elastomer of 0.5 mm or larger, and a topcoat 14, cover successively on a hollow roll 12 made of a metal housing a halogen lamp 11, which acts as a heating source. The heating fixing roll 1 can be controlled at a predetermined temperature by monitoring the surface temperature with a temperature sensor 15. The thickness of the undercoat layer (heat resistant elastomer layer) 13 is preferably 0.5 mm or greater, and more preferably 1 mm or greater.

The endless belt 2 is wound around the heating fixing roll 1 at a predetermined angle so as to form a nip between the endless belt 2 and the heating fixing roll 1. This angle is usually in the range of 10 to 65°, more preferably in the range of 20 to 60°, and particularly preferable in the range of 30 to 50°.

The endless belt 2 is tensed by the rolls 21, 22 and 23, and since the supporting roll 23 is connected to a motor 24, the endless belt 2 can be rotatably driven. For this reason, the supporting roll 23 functions as a driving roll, and can rotate the endless belt 2 in an arrow A direction. Therefore, the heating fixing roll 1 in contact with the endless belt 2 follow-up rotates in an arrow A direction.

In addition, in the present fixing apparatus, a pressure roll 25 is further provided inside the endless belt 2 at an exit of a nip. The pressure roll 25 is contacted with the heating fixing roll 1 by pressure via the endless belt 2, by a connected compression coil spring 26. Hence, the pressure roll 25 can produce strain in the heat resistant elastomer layer of the heating fixing roll 1. Since the pressure roll 25 effectively provides strain to the heating fixing roll 1 at a low load, it is desirable that the roll 25 has a smaller diameter than that of the heating fixing roll 1, and that the surface thereof is hard.

When the pressure roll 25 and the heating fixing roll 1 are contacted under pressure under a load, the surface of the heating fixing roll 1 is elastically deformed at a nip region, and a strain is produced on the surface circumferentially. When the heating fixing roll 1 is rotated and a paper P is passed through a nip region in this state, the paper P is conveyed by a nip region with a strain.

Moreover, in the fixing apparatus, releasing a releasing agent coating apparatus 3 that is effective for promoting the demolding of a transfer material may be provided. The releasing agent coating apparatus 3 is consisted of releasing a releasing agent container 31 and three contacted rolls, 32, 33, and 34. Among these, the roll 32 is arranged on the heating fixing roll 1, and the roll 34 is arranged so as to contact with the releasing agent put in the releasing agent container 31. The releasing agent is applied on a paper P through the heating fixing roll 1 from the releasing agent coating apparatus 3 and the releasing of the paper P is carried out smoothly.

When the releasing agent is applied on a paper P with the releasing agent coating apparatus 3 as exemplified above, it is preferable that the releasing agent is applied on the heating fixing roll 1 so that the amount applied on the paper P will be $1.0\times10^{-6}$ g/cm$^2$ or more and less than $2.0\times10^{-5}$ g/cm$^2$. When the amount applied is $2.0\times10^{-5}$ g/cm$^2$ or more, writing in on the fixed image with a ball-point pen and pasting the adhesive tape may be influenced harmfully, while when the amount applied is less than $1.0\times10^{-6}$ g/cm$^2$, the function as a releasing agent may not be sufficiently exhibited.

As a releasing agent to be applied on the above-mentioned paper P, it is preferable to use organosiloxane that is a silicone composition, and organosiloxane compounds containing an amino group are more preferably used. Particularly, by using amino modified silicone oil that the viscosity is 50 to 10000 cs at 25° C. and more preferably 100 to 1000 cs, the effect can be remarkably improved.

The endless belt 2 is tensed by at least three supporting rolls, one of these supporting rolls is a displacement roll, the other supporting rolls are a fixed roll, and the displacement roll may be constructed so that it can move so as to cross a position of a roll axis with roll axes of other fixed rolls. In this case, waving, creasing and damage of the endless belt 2 can be sufficiently suppressed.

Further, a central axis of the displacement roll may be constructed so as to displace along an elliptic locus, foci of which are central axes of two fixed rolls which are positioned on an upstream side and a downstream side nearest the displacement roll, relative to a rotation direction of the endless belt 2. In this case, a stress of the endless belt 2 is smallest and waving, creasing and damage of the endless belt 2 can be more sufficiently suppressed.

The above-mentioned heating fixing roll 1 may be constituted so as to form a nip with the endless belt 2 stretched between the two fixed rolls. In this case, equivalent fixability can be obtained by smaller load than that in the roll nip method, which is suitable for a high-speed fixing.

On an upstream side of the pressure roll of a nip region formed by the heating fixing roll 1 and the endless belt 2, there may be further provided an elastomer roll contacting with the heating fixing roll 1 by pressure via the endless belt 2 from the inside of the endless belt 2. Whereby, the image alignment preventing function, the self stripping property, the fixability and the like are improved.

A fixing process with the thus constructed fixing apparatus is completed by transferring a paper (transfer receiving material) P having an unfixed toner image T to the endless belt 2, further, advancing P to a nip formed by the heating fixing roll 1 controlled at a predetermined temperature, and a pressure roll 25 via the endless belt 2, heating and contacting the P by pressure, and fixing a toner image T on a paper P.

-Toner Cartridge-

In the following, the toner cartridge used in the method for forming an image of the invention will be described. The toner cartridge used in the method for forming an image of the invention is a toner cartridge that is installed detachably in the image forming apparatus and stores at least the toner to be supplied to the development means installed in the above-mentioned image forming apparatus, and the toner of the invention can be used as the above-mentioned toner.

Therefore, in the image forming apparatus having the constitution in which the toner cartridge is detachable, it is possible to obtain an image that the color tone is excellent, black color level is high, and is excellent in the bending resistance of the image even in the high speed processing by utilizing the toner cartridge storing the toner of the invention.

Moreover, when the image forming apparatus shown in FIG. 1 is the image forming apparatus having the constitution in which the toner cartridge is detachable, for example, the developing device 104 is connected with the toner cartridge (not shown in the figure) by a toner feeding pipe (not shown in the figure).

In this configuration, when an image is formed, because the toner is supplied to developing devices 104 from the toner cartridge corresponding to each developing device through the toner feed pipe, the image can be formed for a long time by using the toner of the invention. Moreover, when the amount of the toner stored in the toner cartridge becomes small, this toner cartridge can be exchanged.

EXAMPLES

Hereinafter, though the invention will be described in detail together with the examples, the invention should not be limited to them at all.

Moreover, the toner in examples can be obtained by the following method.

Amorphous polyester resin particles, the dispersion solution of magnetic metal particles covered with crystalline polyester resin (as need arises, the dispersion solution of colorant particles), and the dispersion solution of releasing agent particles are prepared respectively. In this case, there is no problem if the prescribed amount of a polymer of certain inorganic metal salt is added in the dispersion solution of the magnetic metal particles and the dispersion solution of inorganic particles and stirred to agglomerate them.

Next, while the prescribed amount thereof are mixed and stirred, the polymer of an inorganic metal salt is added thereto and neutralized in ions to form the aggregate of the above-mentioned each particle. Before the prescribed toner particle diameter is achieved, resin particles are additionally added and the toner particle diameter is obtained. After the pH within the system is adjusted in the range of weak acid to neutrality, the system is heated to the glass transition temperature or higher of the resin particles to fuse and coalesce. After the reaction is completed, the desired toner is obtained through the steps of sufficient washing, solid-liquid separation, and drying.

Hereinafter, the method for preparing each material and the method for manufacturing the toner particles will be exemplified.

-Synthesis of Crystalline Polyester Resin (1)-

After 122 parts by mass of ethylene glycol, 23.2 parts by mass of sodium 5-sulfoisophthalate dimethyl, 217 parts by mass of dimethyl sebacate, and 0.3 parts by mass of dibutyltin oxide as a catalyst are put into a three-neck flask dried by heating, air in the container is exchanged with nitrogen gas by reduced-pressure operations to render an inert atmosphere and the mixture is stirred at 180° C. for five hours by mechanical stirring. After that, the mixture is slowly heated to 220° C. under reduced pressure and stirred at the temperature for two hours. Then, the reaction is stopped and thus 220 parts by mass of crystalline polyester resin (1) is synthesized.

As a result of the molecular weight measurement (polystyrene conversion) with gel permeation chromatography (GPC), the weight average molecular weight (Mw) of the obtained crystalline polyester resin (1) is 9900, and the number average molecular weight (Mn) is 6100.

Moreover, the measurement of the average molecular weight is carried out under the following conditions. As GPC, "HLC-8120GPC, SC-8020 (trade name, manufactured by Tosoh Corporation)" is used, two pieces of columns of "TSK gel, Super HM-H (trade name, manufactured by Tosoh Corporation, and 6.0 mm ID×15 cm)" are used, and THF (tetrahydrofuran) is used as an eluate. As experimental conditions, the concentration of a sample is 0.5%, the flow rate is 0.6 ml/min., the amount of an injected sample is 10 μl, and the measurement temperature is 40° C., and the experiment is carried out by using an IR detector. Moreover, the calibration curve is made from ten samples of "polystyrene standard sample: TSK standard (trade name)" manufactured by Tosoh Corporation: "A-500", "F-1", "F-10", "F-80", "F-380", "A-2500", "F-4", "F-40", "F-128", and "F-700". Further, GPC uses the above-mentioned method unless otherwise specified.

Moreover, when the melting point (Tm) of the crystalline polyester resin is measured with a differential scanning calorimeter (DSC) by the above-mentioned measuring method, a clear peak is shown and the temperature of the peak top is 70° C. And the acid value obtained by KOH is 5.5 meq/mg-KOH.

-Synthesis of Crystalline Polyester Resin (2)-

After 122 parts by mass of ethylene glycol, 23.2 parts by mass of sodium 5-sulfoisophthalate dimethyl, 217 parts by mass of dimethyl sebacate, and 0.3 parts by mass of dibutyltin oxide as a catalyst are put into a three-neck flask dried by heating, air in the container is exchanged with nitrogen gas by reduced-pressure operations to render an inert atmosphere and the mixture is stirred at 180° C. for five hours by mechanical stirring. After that, the mixture is slowly heated to 220° C. under reduced pressure and stirred for four hours. Then, the reaction is stopped and thus 220 parts by mass of crystalline polyester resin (2) is synthesized.

As a result of the molecular weight measurement (polystyrene conversion) with gel permeation chromatography (GPC), the weight average molecular weight (Mw) of the obtained crystalline polyester resin (2) is 13000, and the number average molecular weight (Mn) is 8500.

Moreover, when the melting point (Tm) of the crystalline polyester resin is measured with a differential scanning calorimeter (DSC) by the above-mentioned measuring method, a clear peak is shown and the temperature of the top in the peak is 70° C. And the acid value obtained by KOH is 3.2 meq/mg-KOH.

-Preparation of the Dispersion Solution of Amorphous Polyester Resin (1)-

35 molar parts of polyoxyethylene (2,0)-2,2-bis(4-hydroxyphenyl)propane, 65 molar parts of polyoxypropylene (2,2)-2,2-bis(4-hydroxyphenyl)propane, 80 molar parts of terephthalic acid, 10 molar parts of n-dodecenylsuccinic acid, 10 molar parts of trimellitic acid, and 0.05 molar parts relative to these acid components (telephthalic acid, n-dodecenylsuccinic acid, trimellitic acid) of dibutyltin oxide were placed in a heat-dried two-neck flask. A nitrogen gas was introduced into the container to retain the inert atmosphere, the temperature was raised, a copolycondencing reaction was performed at 150 to 230□C for about 12 hours and, thereafter, the pressure was gradually reduced at 210 to 250□C to synthesize a amorphous polyester resin (1).

As a result of the molecular weight measurement (polystyrene conversion) with gel permeation chromatography, the weight average molecular weight (Mw) of the obtained amorphous polyester resin (1) is 15400, and the number average molecular weight (Mn) is 6900.

Moreover, when the DSC spectrum of the amorphous polyester resin is measured with a differential scanning calorimeter (DSC) as the case of the above-mentioned measurement of the melting point, no clear peak is shown and stepwise change in the endothermic amount is observed. The glass transition point obtained from the middle point of the stepwise change in the endothermic amount is 65° C.

One hundred and fifty parts by mass of amorphous polyester resin (1) is put in 850 parts by mass of distilled water and 20 parts by mass of sodium dodecylbenzenesulfonate is added as a surfactant, and then the mixture is mixed and stirred in a homogenizer (trade name: Ultraturrax manufactured by IKA Japan K.K.) while the mixture is heated to 99° C. and the dispersion solution of amorphous polyester resin particles (1) is obtained.

Moreover, the acid value of this amorphous polyester resin (1) that is obtained by KOH is 7 meq/mg-KOH.

(Preparation of the Colorant Dispersion Solution (1))

Carbon black (trade name: R330, manufactured by Cabot Corp.) 45 parts by mass

Ionic surfactant Neogen SC (trade name, manufactured by Dai-Ichi Kogyo Seiyaku Co., Ltd.) 5 parts by mass Ion-exchange water 200 parts by mass The above substances are mixed and dissolved, and dispersed for 10 minutes with a homogenizer (IKA Ultraturrax (trade name)), and then the ultrasonic wave of 28 KHz is irradiated for 10 minutes with an ultrasonic dispersion apparatus and the colorant dispersion solution (1) of 92 nm in central particle diameter is obtained.

(Preparation of the Dispersion Solution of Magnetic Metal Particles (1))

Fifty parts by mass of crystalline polyester resin (1) is dissolved in 25 parts by mass of ethyl acetate, and then 15 parts by mass of IPA is added thereto. This mixture is added in 100 parts by mass of pure water under the temperature of 45° C., and further 15 parts by mass of 10% aqueous ammonium solution is added, and then 100 parts by mass of ferrite particles MTS010 (trade name, manufactured by Toda Kogyo Corporation) of 90 nm in central particle diameter is added and mixed and stirred with a 4-inclined paddle mixer. Next, distilled water which is kept at 45° C. is added to this mixture at the rate of 10 g/min. while the mixture is stirred and the surface of the ferrite is covered with the crystalline polyester resin (1). After the emulsification is observed with eyes, 5% by mass of Neogen SC (linear sodium alkylbenzenesulfonate) (trade name, manufactured by Dai-Ichi Kogyo Seiyaku Co., Ltd.) is added while the emulsion is stirred for 30 minutes, and further stirred at the temperature of 45° C. for 30 minutes to make the surfactant to be absorbed on the surface. After that, the emulsified solution is distilled under reduced pressure (−700 mmHg) for 60 minutes to remove the solvent and the dispersion solution of magnetic metal particles (1) is obtained. Particle size D50 of magnetic metal particles measured in the micro track at this time is 104 nm. Moreover, the acid value obtained by KOH is 3.3 meq/mg-KOH.

A part of this dispersion solution of magnetic metal particles (1) is spread on a glass plate and dried at 25° C., and when the section of the particle is observed, it is confirmed that the magnetic metal particles are covered with the resin.

(Preparation of the Dispersion Solution of Magnetic Metal Particles (2))

The dispersion solution of magnetic metal particles (2) is obtained by the same preparation method as that for the dispersion solution of magnetic metal particles (1), except that the used amount of crystalline polyester resin, the used amount of ethyl acetate, and the used amount of IPA are changed to 10 parts by mass, 5 parts by mass, and 3 parts by mass, respectively. Particle size D50 of magnetic metal particles measured in the micro track at this time is 94 nm. Moreover, the acid value obtained by KOH is 3.4 meq/mg-KOH.

A part of this dispersion solution of magnetic metal particles (2) is spread on a glass plate and dried at 25° C., and when the section of the particle is observed, it is confirmed that the magnetic metal particles are covered with the resin.

(Preparation of the Dispersion Solution of Magnetic Metal Particles (3))

The dispersion solution of magnetic metal particles (3) is obtained by the same preparation method as that for the dispersion solution of magnetic metal particles (1), except that crystalline polyester resin (1) is changed to crystalline polyester resin (2). Particle size D50 of magnetic metal particles measured in the micro track at this time is 106 nm. Moreover, the acid value obtained by KOH is 1.9 meq/mg-KOH.

A part of this dispersion solution of magnetic metal particles (3) is spread on a glass plate and dried at 25° C., and when the section of the particle is observed, it is confirmed that the magnetic metal particles are covered with the resin.

(Preparation of the Dispersion Liquid of Magnetic Metal Particles (4))

The dispersion liquid of magnetic metal particles (4) is obtained by the same preparation method as that for the dispersion liquid of magnetic metal particles (1), except that the used amount of crystalline polyester resin (1) is changed to 8 parts by mass. Particle size D50 of magnetic metal particles measured in the micro track at this time is 91 nm. Moreover, the acid value obtained by KOH is 0.5 meq/mg-KOH.

A part of this dispersion solution of magnetic metal particles (4) is spread on a glass plate and dried at 25° C., and when the section of the particle is observed, the exposure of the magnetic metal particles are observed and it is confirmed that the particles are covered with magnetic metal particles which are covered with resin.

(Preparation of the Dispersion Solution of Releasing Agent (1))

- Polyethylene wax PW500 (trade name, mp is 85° C. and viscosity is 5.2 mPa.·s (180° C.), manufactured by Toyo Petrolite Co., Ltd.) 45 parts by mass
- Cationic surfactant Neogen RK (trade name, manufactured by Dai-Ichi Kogyo Seiyaku Co., Ltd.) 5 parts by mass
- Ion-exchange water 200 parts by mass After the above substances are heated to 95° C. and dispersed sufficiently with Ultraturrax T50 (trade name) manufactured by IKA, further dispersion treatment is conducted using a pressure discharge type gaulin homogenizer and the dispersion solution of a releasing agent (1) of 200 nm in center diameter and 25% in solid content is obtained.

(Manufacture of the Toner 1)

- The dispersion solution of amorphous polyester resin particles (1) 80 parts by mass
- The dispersion solution of magnetic metal particles (1) 12.5 parts by mass
- The dispersion solution of releasing a releasing agent (1) 20 parts by mass
- Polyaluminum chloride 0.41 parts by mass The above substances are mixed and stirred sufficiently with Ultraturrax T50 in a round type stainless flask.

Next, 0.36 parts by mass of polyaluminum chloride is added in the mixture and the dispersing operation is continued-with the UltraturraxT50. The mixture is heated up to 47° C. with a oil bath for heating while the mixture is stirred. And 31 parts by mass of a resin dispersion solution is gradually added in the mixture after being held at 50° C. for 60 minutes.

Then, after the pH in the system is adjusted to be 5.4 with aqueous sodium hydroxide solution of 0.5 mol/L, the stainless flask is sealed up and the mixture is heated to 96° C. while stirred and kept for five hours at the temperature.

After the reaction is ended, the mixture is cooled to 26° C. at the rate of 20° C./minute for three minutes and 30 seconds, and filtered and washed sufficiently with ion-exchange water and then the solid-liquid separation is conducted by the Nutsche type suction filtration. The solid is further dispersed again in 3 L of ion-exchange water of 40° C. and stirred and washed at 300 rpm for 15 minutes.

This operation is further repeated five times, and when pH of the filtrate becomes 6.99, electrical conductivity 9.4 μS/cm, and surface tension 71.1 Nm, the solid-liquid separation is conducted using No. 5A filter paper by Nutsche type suction filtration. Then, the vacuum drying of the filter cake is continued for 12 hours and toner particles are obtained.

When the particle diameter at this time is measured with Coulter counter, the volume average diameter D50 is 5.6 μm and the volume average particle size distribution index GSDv is 1.20. Moreover, the shape factor of the particle SF1 obtained from the shape observation with Luzex device is 128.9 and the shape is observed to be potato-like. And the maximum value of the endothermic peak obtained from the differential thermal analysis on the toner particle is 84° C. and the content of the releasing agent obtained from the area of the endothermic peak is 16% by mass.

Two parts by mass of hydrophobic silica (trade name: TS720, manufactured by Cabot Corp.) is added to the 100 parts by mass of the obtained toner particles and blended with a sample mill to give the toner 1.

(Manufacture of the Toner 2)

The toner 2 is obtained by the same method as that for the manufacture of the toner 1, except for using the dispersion solution of magnetic metal particles (2) in place of the dispersion solution of magnetic metal particles (1). Here, the volume average diameter D50 and the volume average particle size distribution index GSDv of toner 2 before being blended with hydrophobic silica are 5.4 μm and 1.24, respectively. Moreover, the shape factor of the particle SF1 obtained from the shape observation with Luzex device is 135.2 and the shape is observed to be potato-like. And the maximum value of the endothermic peak obtained from the differential thermal analysis on the toner particle is 69° C. and the content of the releasing agent obtained from the area of the endothermic peak is 19% by mass.

(Manufacture of the Toner 3)

The toner 3 is obtained by the same method as that for the manufacture of the toner 1, except for using the dispersion solution of magnetic metal particles (3) in place of the dispersion solution of magnetic metal particles (1). Here, the volume average diameter D50 and the volume average particle size distribution index GSDv of toner 3 before being blended with hydrophobic silica are 5.5 μm and 1.22, respectively. Moreover, the shape factor of the particle SF1 obtained from the shape observation with Luzex device is 130.8 and the shape is observed to be potato-like. And the maximum value of the endothermic peak obtained from the differential thermal analysis on the toner particle is 69° C. and the content of the releasing agent obtained from the area of the endothermic peak is 14% by mass.

(Manufacture of the Toner 4)

The toner 4 is obtained by the same method as that for the manufacture of the toner 1, except for using the dispersion solution of magnetic metal particles (4) in place of the dispersion solution of magnetic metal particles (1). Here, the volume average diameter D50 and the volume average particle size distribution index GSDv of toner 4 before being blended with hydrophobic silica are 5.3 μm and 1.22, respectively. Moreover, the shape factor of the particle SF1 obtained from the shape observation with Luzex device is 130.8 and the shape is observed to be potato-like. And the maximum value of the endothermic peak obtained from the differential thermal analysis on the toner particle is 70° C. and the content of the releasing agent obtained from the area of the endothermic peak is 16% by mass.

Example 1

Using the toner 1, after the applied amount of the toner is adjusted to be 4.5 g/m$^2$ with a remolded machine of Able 3300 (trade name, manufactured by Fuji Xerox Co., Ltd.) and an image is brought out, the image is fixed at the fixing rate of 350 mm/sec. under Nip of 6.5 mm with a fixing apparatus of high speed, low pressure and low electric power shown in FIG. 2.

When the obtained image is evaluated, the black color level of the image is good, there is neither scattering nor fog of the toner, and it is confirmed to show good charging property. In addition, when the presence of defect in the fixed image in case of folding the image in two and opening it again, no defect is confirmed.

Moreover, the removability of the fixing apparatus is good and it is confirmed that the image is released without any resistance, and no offset is generated at all. Further, when the fixed image is folded in half and unfolded again, no defect in the image is confirmed.

Example 2

Using the toner 2, after the applied amount of the toner is adjusted to be 4.5 g/m$^2$ with a remolded machine of Able 3300 (trade name, manufactured by Fuji Xerox Co., Ltd.) and an image is brought out, the image is fixed at the fixing rate of 350 mm/sec. under Nip of 6.5 mm with a fixing apparatus of high speed, low pressure and low electric power shown in FIG. 2.

When the obtained image is evaluated, the black color level of the image is good and a fine image is obtained. Further, there is neither scattering nor fog of the toner, and it is confirmed to show good charging property.

Moreover, the removability of the fixing apparatus is good and it is confirmed that the image is released without any resistance, and no offset is generated at all. Further, when the fixed image is folded in half and unfolded again, no defect in the image is confirmed.

Example 3

Using the toner 3, after the applied amount of the toner is adjusted to be 4.5 g/m$^2$ with a remolded machine of Able 3300 (trade name, manufactured by Fuji Xerox Co., Ltd.) and an image is brought out, the image is fixed at the fixing rate of 350 mm/sec. under Nip of 6.5 mm with a fixing apparatus of high speed, low pressure and low electric power shown in FIG. 2.

When the obtained image is evaluated, the black color level of the image is good and a fine image is obtained. Further, neither scattering nor fog of the toner is observed, and it is confirmed to show good charging property.

Moreover, the removability of the fixing apparatus is good and it is confirmed that the image is released without any resistance, and no offset is generated at all. Further, when the fixed image is folded in half and unfolded again, no defect in the image is confirmed.

Comparative Example 1

Using the toner 4, after the applied amount of the toner is adjusted to be 4.5 g/m$^2$ with a remolded machine of Able 3300 (trade name, manufactured by Fuji Xerox Co., Ltd.) and an image is brought out, the image is fixed at the fixing rate of 350 mm/sec. under Nip of 6.5 mm with a fixing apparatus of high speed, low pressure and low electric power shown in FIG. 2.

When the obtained image is evaluated, the black color level of the image is seen slightly red and the fineness of the image is not sufficient. Further, the scattering and fog of the toner are observed.

And, though the removability of the fixing apparatus is good and it is confirmed that the image is released without any resistance, and no offsetting is generated at all, when the fixed image is folded in half and unfolded again, remarkable defect in the image is observed. Further, when the image is brought out, neither scattering nor fog of the toner is observed.

From these examples, as for the toner that uses specific magnetic metal particles, it is understood that the color tone is good, black color level is high, and the charging characteristics is excellent.

Moreover, it is also understood that using the toners shown in the examples, there is no scattering and fine images are obtained, and further there is no dispersion of removability by temperature in the oilless fixing, and that the toners are excellent in the fixing characteristics such as adhesion of the fixing image to the fixing sheet, the removability of a fixed sheet, and HOT resistance (hot offset property).

The invention includes the following exemplary embodiments.

<1> A toner for electrostatic charge development comprising an amorphous polyester resin, a releasing agent, and magnetic metal particles covered with a resin the main component of which is a crystalline polyester resin.

<2> A toner for electrostatic charge development according to <1>, wherein the melting point of the crystalline polyester resin is in the range of about 60 to 90° C. and the content of the crystalline polyester resin is in the range of about 5 to 30% by mass with respect to the total amount of binder resin(s) constituting the toner.

<3> A toner for electrostatic charge development according to any one of <1> and <2>, wherein when manufacturing the toner it is cooled from the melting point of the crystalline polyester resin to a temperature of 60° C. or lower at the rate of 15° C./min or more.

<4> A toner for electrostatic charge development according to any one of through <1> to <3>, wherein the diameter of the magnetic metal particles is in the range of about 50 to 250 nm.

<5> A toner for electrostatic charge development according to any one of through <1> to <4>, wherein the content of the magnetic metal particles is in the range of about 5 to 50% by mass of the toner.

<6> A toner for electrostatic charge development according to any one of through <1> to <5>, wherein the shape factor (SF1) is about 110 to 140.

<7> A toner for electrostatic charge development according to any one of through <1> to <6>, wherein the volume average particle size distribution index (GSDv) is about 1.3 or less.

<8> A toner for electrostatic charge development according to any one of through <1> to <7>, wherein the viscosity of the releasing agent at 180° C. is about 150 mPa·s or less, and the maximum value of the endothermic peak(s) obtained by differential thermal analysis of the toner is in the range of about 70 to 120° C. and the content of the releasing agent obtained from the area of the endothermic peak(s) is in the range of about 5 to 30% by mass.

<9> A method for forming an image comprising: uniformly charging the surface of an image holding member; forming an electrostatic latent image on the surface of the uniformly charged image holding member based on image information; developing the electrostatic latent image formed on the surface of the image holding member with a developer containing the toner for electrostatic charge development according to any one of through <1> to <8> to obtain a toner image; fusing the toner image onto the surface of a recording medium.

<10> A method for manufacturing the toner for electrostatic charge development according to any one of through <1> to <8>, the method for manufacturing the toner for electrostatic charge development comprising: an aggregation process, where a dispersion solution of resin particles in which at least resin particles of 1 μm or less are dispersed, a dispersion solution of magnetic metal particles in which magnetic metal particles covered with a crystalline polyester resin are dispersed, and a dispersion solution of releasing agent particles in which releasing agent particles are dispersed, are mixed to form aggregated particles of the resin particles, the magnetic metal particles covered with the crystalline polyester resin, and the releasing agent particles; and a coalescence process where the aggregated particles are heated to the temperatures of the glass transition point or higher of the resin particles and are fused and coalesced.

<11> A method for manufacturing the toner for electrostatic charge development according to <10> comprising: further containing an aggregation process in which the aggregated particles are cooled to a temperature of 60° C. at the rate of 15° C./min or more.

<12> A method for manufacturing the toner for electrostatic charge development according to any one of through <1> to <8>, comprising: dissolving the crystalline polyester resin; adding the magnetic metal particles to the solution in the presence of an anionic surfactant while the solution is stirred and sheared at a temperature at, or higher than, the melting point of the resin and at, or less than, the boiling point of the solvent, covering the magnetic metal particles with the crystalline polyester resin; and then adding thereto water of equivalent weight or more to give an emulsified dispersion solution of the magnetic metal particles.

What is claimed is:

1. A toner for electrostatic charge development comprising an amorphous polyester resin, a releasing agent, and magnetic metal particles covered with a resin the main component of which is a crystalline polyester resin.

2. A toner for electrostatic charge development comprising an amorphous polyester resin, a releasing agent, and magnetic metal particles covered with a resin the main component of which is a crystalline polyester resin, having a melting point in the range of about 60 to 90° C. and content thereof in the range of about 5 to 30% by mass with respect to the total amount of binder resin(s) constituting the toner.

3. The toner for electrostatic charge development according to claim 1, wherein when manufacturing the toner it is cooled from the melting point of the crystalline polyester resin to a temperature of 60° C. or lower at the rate of 15° C./min or more.

4. The toner for electrostatic charge development according to claim 1, wherein the diameter of the magnetic metal particles is in the range of about 50 to 250 nm.

5. The toner for electrostatic charge development according to claim 1, wherein the content of the magnetic metal particles is in the range of about 5 to 50% by mass of the toner.

6. The toner for electrostatic charge development according to claim 1, wherein the shape factor (SF1) is in the range of about 110 to 140.

7. The toner for electrostatic charge development according to claim 1, wherein the volume average particle size distribution index (GSDv) is about 1.3 or less.

8. The toner for electrostatic charge development according to claim 1, wherein the viscosity of the releasing agent at 180° C. is about 150 mPa·s or less, and the maximum value of the endothermic peak(s) obtained by differential thermal analysis of the toner is in the range of about 70 to 120° C. and the content of the releasing agent obtained from the area of the endothermic peak(s) is in the range of about 5 to 30% by mass.

9. A toner for electrostatic charge development, comprising:

an amorphous polyester resin; a releasing agent: and magnetic metal particles covered with a resin the main component of which is a crystalline polyester resin;

the melting point of the crystalline polyester resin being in the range of about 60 to 90° C., the content of the crystalline polyester resin being in the range of about 5 to 30% by mass with respect to the total amount of the binder resin(s) constituting the toner; and the toner during manufacture thereof being cooled from the melting point of the crystalline polyester resin to a temperature of 60° C. or lower at the rate of 15° C./min or more;

the diameter of the magnetic metal particle being in the range of about 50 to 250 nm and the content of the magnetic metal particle being in the range of about 5 to 50% by mass of the toner;

the shape factor (SF1) of the toner being about 110 to 140;

the volume average particle size distribution index (GSDv) of the toner being 1.3 or less; and the viscosity of the releasing agent at 180° C. being about 150 mPa·s or less, and the maximum value of the endothermic peaks obtained by differential thermal analysis of the toner being in the range of about 70 to 120° C. and the content of the releasing agent obtained from the area of the endothermic peak(s) being in the range of about 5 to 30% by mass.

10. A method for forming an image comprising: uniformly charging the surface of an image holding member; forming an electrostatic latent image on the surface of the uniformly charged image holding member based on image information; developing the electrostatic latent image formed on the surface of the image holding member with a developer containing the toner for electrostatic charge development according to claim 1 to obtain a toner image; fusing the toner image onto the surface of a recording medium.

11. A method for forming an image comprising: uniformly charging the surface of an image holding member; forming an electrostatic latent image on the surface of the uniformly charged image holding member based on image information; developing the electrostatic latent image formed on the surface of the image holding member with a developer containing the toner for electrostatic charge development according to claim 2 to obtain a toner image; fusing the toner image onto the surface of a recording medium.

12. A method for forming an image comprising: uniformly charging the surface of an image holding member; forming an electrostatic latent image on the surface of the uniformly charged image holding member based on image information; developing the electrostatic latent image formed on the surface of the image holding member with a developer containing the toner for electrostatic charge development according to claim 4 to obtain a toner image; fusing the toner image onto the surface of a recording medium.

13. A method for forming an image comprising: uniformly charging the surface of an image holding member; forming an electrostatic latent image on the surface of the uniformly charged image holding member based on image information; developing the electrostatic latent image formed on the surface of the image holding member with a developer containing the toner for electrostatic charge development according to claim 9 to obtain a toner image; fusing the toner image onto the surface of a recording medium.

14. A method for manufacturing the toner for electrostatic charge development according to claim 1, the method for manufacturing the toner for electrostatic charge development comprising: an aggregation process, where a dispersion solution of resin particles in which at least resin particles of 1 μm or less are dispersed, a dispersion solution of magnetic metal particles in which magnetic metal particles covered with a crystalline polyester resin are dispersed, and a dispersion solution of releasing agent particles in which releasing agent particles are dispersed, are mixed to form aggregated particles of the resin particles, the magnetic metal particles covered with the crystalline polyester resin, and the releasing agent particles; and a coalescence process where the aggregated particles are heated to the temperatures of the glass transition point or higher of the resin particles and are fused and integrated.

15. A method for manufacturing the toner for electrostatic charge development according to claim 2, the method for manufacturing the toner for electrostatic charge development comprising: an aggregation process, where a dispersion solution of resin particles in which at least resin particles of 1 μm or less are dispersed, a dispersion solution of magnetic metal particles in which magnetic metal particles covered with a crystalline polyester resin are dispersed, and a dispersion solution of releasing agent particles in which releasing agent particles are dispersed, are mixed to form aggregated particles of the resin particles, the magnetic metal particles covered with the crystalline polyester resin, and the releasing agent particles; and a coalescence process where the aggregated particles are heated to the temperatures of the glass transition point or higher of the resin particles and are fused and integrated.

16. A method for manufacturing the toner for electrostatic charge development according to claim 4, the method for manufacturing the toner for electrostatic charge development comprising: an aggregation process, where a dispersion solution of resin particles in which at least resin particles of 1 μm or less are dispersed, a dispersion solution of magnetic metal particles in which magnetic metal particles covered with a crystalline polyester resin are dispersed, and a dispersion solution of releasing agent particles in which releasing agent particles are dispersed, are mixed to form aggregated particles of the resin particles, the magnetic metal particles covered with the crystalline polyester resin, and the releasing agent particles; and a coalescence process where the aggregated particles are heated to the temperatures of the glass transition point or higher of the resin particles and are fused and coalesced.

17. A method for manufacturing the toner for electrostatic charge development according to claim 1, the method for manufacturing the toner for electrostatic charge development comprising: disolving the crystalline polyester resin in a solvent; adding the magnetic metal particles to the solution in the presence of an anionic surfactant while the solution is stirred and sheared at a temperature at, or higher than, the melting point of the resin and at, or less than, the boiling point of the solvent, covering the magnetic metal particles with the crystalline polyester resin; and then adding thereto water of equivalent weight or more to give an emulsified dispersion solution of the magnetic metal particles.

18. A method for manufacturing the toner for electrostatic charge development according to claim 2, the method for manufacturing the toner for electrostatic charge development comprising: disolving the crystalline polyester resin in a solvent; adding the magnetic metal particles to the solution in the presence of an anionic surfactant while the solution is stirred and sheared at a temperature at, or higher than, the melting point of the resin and at, or less than, the boiling point of the solvent, covering the magnetic metal particles with the crystalline polyester resin; and then adding thereto water of equivalent weight or more to give an emulsified dispersion solution of the magnetic metal particles.

19. A method for manufacturing the toner for electrostatic charge development according to claim 4, the method for manufacturing the toner for electrostatic charge development comprising: disolving the crystalline polyester resin in a solvent; adding the magnetic metal particles to the solution in the presence of an anionic surfactant while the solution is stirred and sheared at a temperature at, or higher than, the melting point of the resin and at, or less than, the boiling point of the solvent, covering the magnetic metal particles with the crystalline polyester resin; and then adding thereto water of equivalent weight or more to give an emulsified dispersion solution of the magnetic metal particles.

* * * * *